United States Patent [19]

Ozawa et al.

[11] 4,195,566

[45] Apr. 1, 1980

[54] MULTICOLOR ROTARY PRESS FOR BOTTLES

[75] Inventors: Kazumi Ozawa, Koga; Shinichiro No, Koganei, both of Japan

[73] Assignee: Kabushiki Kaisha Yakult Honsha, Tokyo, Japan

[21] Appl. No.: 892,860

[22] Filed: Mar. 31, 1978

[30] Foreign Application Priority Data

Mar. 31, 1977 [JP] Japan ..... 52-40466[U]

[51] Int. Cl.[2] ..... B41F 17/08

[52] U.S. Cl. ..... 101/38 R; 101/177; 101/218

[58] Field of Search ..... 101/38 R, 38 A, 39, 101/40, 137, 218, 217, 177

[56] References Cited

U.S. PATENT DOCUMENTS

| | | | |
|---|---|---|---|
| 2,764,933 | 10/1956 | Hargrave | 101/38 R |
| 4,035,214 | 7/1977 | Shuppert et al. | 101/40 X |

FOREIGN PATENT DOCUMENTS

| | | | |
|---|---|---|---|
| 24-7417 | 8/1949 | Japan | 101/40 |
| 48-57105 | 7/1973 | Japan | 101/40 |
| 49-25501 | of 1974 | Japan | 101/40 |

*Primary Examiner*—Clifford D. Crowder

*Attorney, Agent, or Firm*—Wenderoth, Lind & Ponack

[57] ABSTRACT

A multicolor rotary press for bottles has rotary transfer cylinder with a silicone rubber periphery having of six retractable transfer surfaces disposed at equal angular intervals therearound and alternating with stationary transfer surfaces. During the rotation of the transfer cylinder, one of two stamping photogravure rolls in rotational engagement therewith transfers an image with a first color to that retractable transfer surface then coming thereunder. The image bearing surface comes under the other roll and is temporarily retractable and that roll transfers another image with a second color to the next stationary transfer surface. Both image bearing surfaces travel past and engage a bottle rotating while engaging the transfer cylinder to print the image on the bottle.

2 Claims, 12 Drawing Figures

MULTICOLOR ROTARY PRESS FOR BOTTLES

BACKGROUND OF THE INVENTION

This invention relates to a multicolor rotary press for printing circular bottles, and more particularly to a multicolor rotary photogravure offset press for continuously and simultaneously printing a polychrome on a container of circular cross section formed of plastic or glass.

When printing the parts of a polychrome on circular containers, rotary photogravure offset presses of the conventional construction have encountered the problem that, when a transfer image of one color is formed on the transfer cylinder or blanket bearing an image of a different color previously transferred thereto, the stamping photogravure roll involved may peel the transfer image of the different color off the transfer cylinder. In order to solve the problem, it has been proposed to interpose a retransfer cylinder having a different exfoliation characteristic from the transfer cylinder between the marking roll and the stamping roll. This measure has resulted in the unavoidable disadvantage that stamping rolls in the later stages interfere with transfer images already formed on the transfer cylinder and damage them.

Japanese laid-open patent application No. 131712/1976 discloses and claims a simultaneous division multicolor printing system for forming transfer images having different colors on a transfer cylinder by stamping rolls each divided into at least two portions axially thereof. The printing system disclosed in the cited patent application makes it possible to effect multicolor printing without the stamping rolls interferring with transfer images as above described. However, the printing system is applicable only to multicolor printings divided in a direction parallel to the rotational axis of the transfer cylinder or in the longitudinal direction of containers to be printed, because of the principle of operation thereof.

Accordingly, it is an object of the present invention to provide a new and improved multicolor rotary photogravure offset press for simultaneously printing images in different colors on a surface of a circular bottle not only in the longitudinal direction but also in the circumferential direction thereof with a high definition.

SUMMARY OF THE INVENTION

The present invention provides a multicolor rotary photogravure offset press for printing an image including divided portions in multicolor on the outer surface of a circular container, comprising a rotary transfer cylinder including a transfer surface divided into a plurality of transfer surface sections one for each of the different colors imparted to the divided image portions respectively and adapted to engage a circular container to be printed disposed in rotational engagement with the transfer surface of the transfer cylinder, a plurality of stamping photogravure rolls disposed in rotational engagement with the transfer surface of the transfer cylinder and having respective image portions formed thereon corresponding to the divided image portions respectively, the stamping rolls being positioned in relation to the transfer surface sections respectively so that each of the stamping rolls transfers the image portion formed thereon to the assigned transfer surface section when opposed to the same during the rotational movement of the transfer cylinder, and supporting means on said transfer cylinder for supporting each of transfer surface sections other than the transfer surface section last receiving the image portion from the associated stamping roll so as to permit it to more radially inwardly within the transfer cylinder, the arrangement being such that, during the rotational movement of the transfer cylinder, each of the transfer surface sections receives the image portions transferred from the associated stamping roll after which the same temporarily moves radially inwardly within the transfer cylinder each time it is opposed to a different one of the stamping rolls other than the one transferring the image portion to the same and then all the transfer surface sections bearing the image portions respectively successively engage to the rotating container to print successively the image portions on the outer surface of the rotating container one after another.

BRIEF DESCRIPTION OF THE DRAWING

The present invention will become more readily apparent from the following detailed description taken in conjunction with the accompanying drawing in which.

DESCRIPTION OF THE PREFERRED EMBODIMENT

Figure 1:
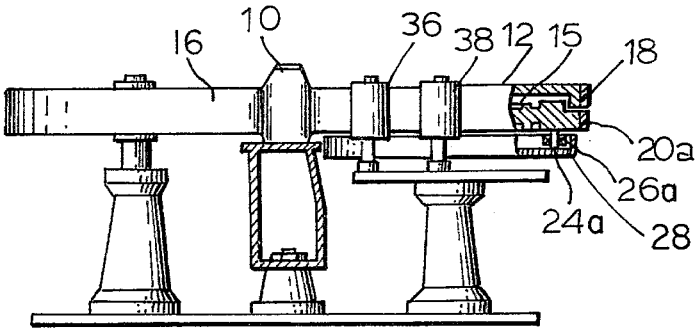
FIG. 1 is a side elevational view of a multicolor rotary photogravure offset press constructed in accordance with the principles of the present invention with parts illustrated in section.

Referring now to FIG. 1 of the drawing, there is illustrated one embodiment according of the multicolor rotary photogravure offset press of the present invention by which a circular container is printed with two different colors on two portions of the outer surface thereof circumferentially adjacent to each other. The arrangement illustrated shows a circular container 10 which is a circular cross-section bottle rotatably sandwiched between a rotary transfer cylinder 12 and a rotary impression cylinder 16. The bottle 10 is formed of a plastic material. The transfer cylinder 12 includes a circular transfer surface layer 18 divided into a plurality of transfer surface sections. In this case, the transfer layer 18 is formed of a silicone rubber and includes six retractable transfer surface sections 20*a*, 20*b*, 20*c*, 20*d*, 20*e* and 20*f* disposed at equal angular intervals of 160 degrees and alternating stationary transfer surface sections 22*a*, 22*b*, 22*c*, 22*d*, 22*e* and 22*f* longer in arc length than the retractable surface sections.

Each of the retractable transfer surface sections, for example, the surface section 20*a*, includes a pin 24*a* pendent from the lower surface thereof and having a bearing 26*a* journalled thereon as best shown in FIG. 1. The bearing 26*a* engages the inner peripheral surface of a stationary cam guide 28 disposed below the transfer cylinder 12 and coaxial therewith.

Figure 4:
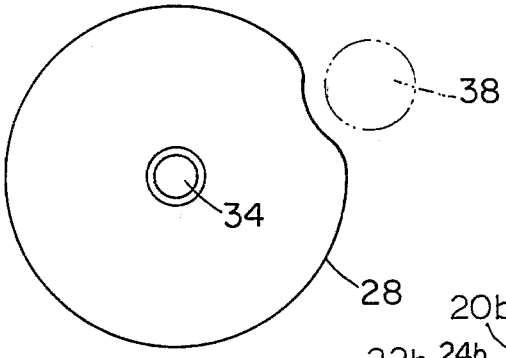
FIG. 4 is a bottom plan view of the cam guide shown in FIG. 1.

The cam guide 28 is smaller in diameter than the transfer cylinder 12 and has a portion thereof opposed to a stamping roll 38, as will be described later, and projecting radially inward as shown in FIG. 4. During the rotation of the transfer cylinder 12, the bearing 26*a* moves along the inner peripheral surface of the cam guide 28 until the surface section 20*a* reaches the position where it opposes the stamping roll 38. At that time, the cam guide 28 engages the inwardly projecting peripheral surface portion opposing the stamping roll 38 so that the bearing 26*a* is moved radially inwardly to retract the transfer surface section 20*a* in a radially inward direction.

When the transfer cylinder 12 is further rotated to move the bearing 26*a* past the inwardly projecting peripheral surface portion of the cam guide 28, the surface section 20*a* is returned to its original position. This is accomplished by a compression spring 30*a* disposed within the transfer cylinder 12 having one end fixedly secured to a fitting 32 mounted on a rotary shaft 34 for the transfer cylinder 12 and the other end engaging a radially inwardly extending part of the surface section 20*a*. The compression spring 30*a* urges the transfer surface section 20*a* radially outwardly.

Each of the remaining retractable transfer surface sections 20*b* through 20*f* has the same components identical to those above described. Those components are designated by the like reference numerals and suffixed with the reference character b, c, d, e or f identifying the associated transfer surface section. For example, 26*c* designates the bearing operatively coupled to the surface section 20*c*. Thus, those transfer surface section operate in the same manner as the transfer surface section 20*a*.

From the foregoing it is seen that the retractable transfer surface sections 20*a* through 20*f* are supported by the fitting 32 through respective supporting mechanisms formed of the components 24*a* through 24*f* and 26*a* through 26*f* as above described so as to be normally flush with the adjacent stationary transfer surface sections 22*a* through 22*f* by means of the action of the associated compression springs 30*a* through 30*f*. The supporting mechanisms are also responsive to a cam mechanism formed of the cam guide 28 and the associated bearing 26*a*, 26*b* . . . 26*f* to cause the associated retractable transfer surface section to move radially inwardly within the transfer cylinder 12 to the position of the surface section 20*a* in FIG. 2. That is, the bearings 26*a*, 26*b* . . . 26*f* are respectively moved toward the rotational shaft 34 a predetermined minute distance and against the action of the associated compression spring 30*a*, 30*b* . . . 30*f* thereby to retract the mating transfer surface section an amount corresponding to the movement of the bearing. Moreover, it will be seen that the adjacent transfer surfaces 20*a* and 22*a*, 20*b* and 22*b* . . . 20*f* and 22*f* form sets of two such surfaces, the leading surface being the retractable surface. The arrangement further comprises pair of stamping photogravure rolls 36 and 38 disposed in rotational engagement with the transfer surface layer 18 of the transfer cylinder 12 and angularly spaced from each other.

From the foregoing it is seen that the arrangement is basically similar in operation to rotary photogravure offset presses of the well known type excepting that, in order to effect the simultaneous two color printing, a pair of stamping photogravure rolls are operatively engaged with the transfer cylinder one for each color and parts of the transfer surface are retractable.

In operation, the gravure rolls 36 and 38 are supplied with two types of gravure ink of different colors from each other to form predetermined image portions on the surfaces thereof respectively. For example, the image portion on the roll 36 may be square and that on the roll 38 may be rectangular. These image portions when transferred to the bottle 10 form the desired image colored as desired.

Figure 2:
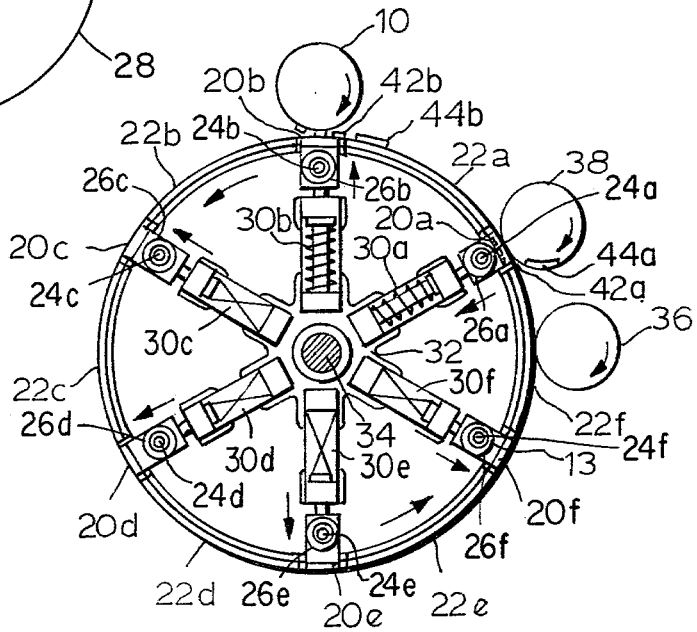
FIG. 2 is a plan view of the essential portion of the arrangement shown in FIG. 1 as viewed from the bottom.
Figure 3A:
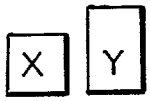
FIGS. 3*a*–3*i* is schematic diagram illustrating various patterns in which the transfer image may be divided into portions according to the present invention.
Figure 3B:
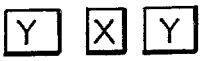
Figure 3C:
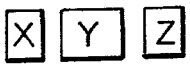
Figure 3D:
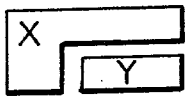
Figure 3E:
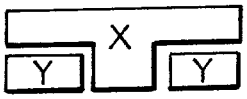
Figure 3F:
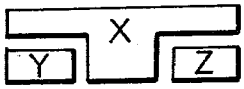
Figure 3G:
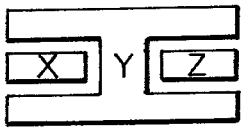
Figure 3H:
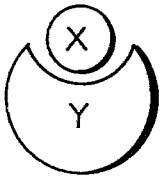
Figure 3I:
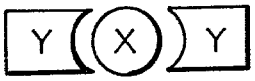

As shown by the arrows in FIG. 2, the transfer cylinder 12 is rotated in the counterclockwise direction as viewed in the Figure and the bottle 10, and the stamping rolls 36 and 38 are rotated in the clockwise direction while engaging the transfer cylinder 12.

Under these circumstances, when each of the retractable transfer surface sections, for example, the surface section 20*a* comes opposite the stamping roll 36, it remains in its normal position and engages the image bearing portion of the stamping roll 36. As a result, the image portion 42*a* is transferred to the retractable transfer surface section engaging the roll.

During a further rotational movement of the transfer cylinder 12, the image bearing surface section 20*a* bearing the image portion 42*a* as shown by dots in FIG. 2 comes opposite the stamping roll 38 whereupon it is temporarily retracted to the position illustrated in FIG. 2. Therefore the stamping roll 38 is prevented from damaging or peeling the image portion on the retractable transfer surface section 20*a*. When the image bearing surface section 20*a* leaves the stamping roll 38, it is immediately returned to its normal position while the next succeeding stationary transfer surface section such as the surface section 22*f* engages the stamping roll 38. Because that portion of the roll 38 engaging the stationary surface section, e.g. section 22*f*, carries an image portion 44*a*, as shown by the arc on the roll 38 in FIG. 2, that image portion is transferred to that portion of the stationary surface section engaging the roll 38.

In the arrangement of FIG. 2, each of the stationary transfer surface sections 22*a*–22*f* receives the image portion from the stamping roll 38 after the corresponding retractable section 20*a*–20*f* has received an image portion from the stamping roll 36.

The transfer cylinder 12 is further rotated until the retractable and stationary surface sections bearing the image portions respectively come successively opposite the rotating bottle 10. In FIG. 2 the surface sections 20*b* and 22*a* carrying image portions 42*b* and 44*b* are coming opposite the rotating bottle. At that time, as the retractable surface section is not depressed, and the image portions are successively transferred to the outer surface of the rotating bottle, this is, those image portions are printed on the outer surface of the bottle 10.

Then the printed bottle 10 is carried out by bottle transport means (not shown) and the next succeeding bottle is fed between the cylinders 12 and 16. The latter bottle is printed by repeating the process as above described.

The image portions 42*b* and 44*b* carried on the transfer surface sections 20*b* and 22*a* respectively have been transferred from the stamping rolls 36 and 38 respectively in the just preceding transfer cycle.

From the foregoing it is to be understood that only when each of the retractable transfer surface sections 20*a* through 20*f* reaches the position where it opposes to the stamping roll 38, it is retracted as above described.

The present invention has been illustrated and described in conjunction with divided two color printing that is the simplest and the resulting printing is shown by a pattern A in FIG. 3.

FIG. 3 shows various divided patterns which can be printed on circular containers by the present invention. In FIG. 3, the reference characters X, Y and Z designate different colors respectively and areas labelled with those reference characters can be printed letters and/or figures. In a printed pattern shown in each of FIGS. 3*a* through 3*i* any desired area may be printed by the retractable transfer surface section. For example, pattern C can be printed in three different colors, and requires three stamping rolls.

It will readily be understood by those skilled in the art that the transfer surface of the transfer cylinder can be divided into a plurality of transfer surface sections and the number of and configuration of the parts applied to stamping rolls can be selected to be suited to any of printed patterns such as shown in FIG. 3. In this case, that transfer surface section last receiving an image from an associated stamping roll is not required to be retractable because the preliminarily transferred image is no longer contacted by the stamping roll and accordingly the image is not damaged, and therefore it is sufficient if the number of the retractable transfer surface sections is one less than the number of colors required for a printed image. If desired, all the transfer surface sections may be retractable.

Thus it is seen that the present invention makes it possible to effect efficiently a wide variety of simultaneous divided multicolor printings which are excellent in both design and accuracy and having a high quality.

While the present invention has been illustrated and described in conjunction with a single preferred embodiment thereof it is to be understood that numerous changes and modifications may be resorted to without departing from the spirit and scope of the present invention. For example, the present invention is equally applicable to any desired pairs of depressible and stationary transfer surface sections for two color printings. In the latter case, the number of surface section may be selected in accordance with the diameter of the transfer cylinder, the dimension of the printed area, the printing speed etc., as in conventional transfer cylinders for printing circular containers. Also hydraulic cylinder means may be used to retract the retractable transfer surface sections.

What we claim is:

1. A multicolor rotary photogravure offset press for printing an image having divided portions of different colors on the outer surface of a circular cross-section body, comprising: a rotary transfer cylinder having a cylindrical transfer surface consisting of at least one set of a plurality of transfer surface sections, one for each of the different colors of the image portions; means for holding a circular cross-section body in rotational engagement with said transfer surface of the transfer cylinder; means for rotating said rotary transfer cylinder for moving said transfer surface sections past said body for transferring image portions on said transfer surface sections to said body; a plurality of stamping photogravure rolls disposed in rotational engagement with said transfer surface of the transfer cylinder for transferring respective image portions corresponding to the divided image portions which have previously been placed thereon to said transfer surface sections, said stamping rolls corresponding to respective transfer surface sections in each set for transferring the image portion thereon to the corresponding transfer surface section when said transfer surface section is opposed to the stamping roll during the rotational movement of the transfer cylinder; a supporting means for supporting each of the transfer surface sections, other than the transfer surface section last receiving an image portion of an image from a corresponding stamping roll during rotation of said transfer cylinder, for movement of said thus movably supported transfer surface sections radially inwardly within the transfer cylinder; and retracting means engaging said supporting means for, during the rotational movement of the transfer cylinder, retracting each of the movably supported transfer surface sections each time it passes a stamping roll after having the corresponding image portion transferred thereto; whereby image portions transferred onto transfer surface sections other than the transfer surface section last receiving an image portion from a stamping roll are not contacted by stamping rolls positioned between the stamping roll from which an image portion is received and the position of the body to be printed.

2. A multicolor rotary photogravure offset press as claimed in claim 1 in which there is a plurality of sets of transfer surface sections and each set of transfer surface sections has two transfer surface sections, the leading transfer surface section of each set being retractable, said sets being spaced at equal angular intervals around the transfer cylinder, and in which there are two stamping rolls, whereby said press can print a two color image on a body each time a set of transfer surface sections moves past the position of the body.

* * * * *